US007963274B2

(12) United States Patent
Joergl et al.

(10) Patent No.: US 7,963,274 B2
(45) Date of Patent: Jun. 21, 2011

(54) TWO COMPONENT LOW PRESSURE EGR MODULE

(75) Inventors: Volker Joergl, Ortonville, MI (US); Timm Kiener, Lake Orion, MI (US); Robert S. Czarnowski, Oxford, MI (US)

(73) Assignee: BorgWarner Inc., Auburn Hills, MI (US)

( * ) Notice: Subject to any disclaimer, the term of this patent is extended or adjusted under 35 U.S.C. 154(b) by 343 days.

(21) Appl. No.: 12/224,402

(22) PCT Filed: Mar. 22, 2007

(86) PCT No.: PCT/US2007/007074

§ 371 (c)(1),
(2), (4) Date: Aug. 26, 2008

(87) PCT Pub. No.: WO2007/111919

PCT Pub. Date: Oct. 4, 2007

(65) Prior Publication Data

US 2009/0056683 A1 Mar. 5, 2009

Related U.S. Application Data

(60) Provisional application No. 60/784,568, filed on Mar. 22, 2006.

(51) Int. Cl.
*F02B 47/08* (2006.01)
*F02B 47/00* (2006.01)

(52) U.S. Cl. ..... 123/568.19; 123/568.12

(58) Field of Classification Search ..... 123/568.19, 123/568.21, 568.12, 559.1, 316; 701/108; 60/605.1, 605.2

See application file for complete search history.

(56) References Cited

U.S. PATENT DOCUMENTS

| | | | | |
|---|---|---|---|---|
| 4,020,809 | A | 5/1977 | Kern et al. | |
| 4,064,851 | A | 12/1977 | Wessel | |
| 4,296,724 | A | 10/1981 | Iizuka et al. | |
| 4,924,840 | A * | 5/1990 | Wade | 123/568.19 |
| 6,000,222 | A | 12/1999 | Regnier | |
| 2003/0000497 | A1 | 1/2003 | Brosseau et al. | |

FOREIGN PATENT DOCUMENTS

| | | | |
|---|---|---|---|
| DE | 2 314 461 | | 10/1974 |
| DE | 30 07 927 | | 9/1981 |
| EP | 0 900 930 | A2 | 3/1999 |
| EP | 1 103 715 | A1 | 5/2001 |
| EP | 1 420 159 | A2 | 5/2004 |
| WO | WO 00/28203 | | 5/2000 |
| WO | WO 00/42305 | | 7/2000 |
| WO | WO 2006/056279 | A1 | 6/2006 |
| WO | WO 2007089771 | A2 * | 8/2007 |

* cited by examiner

*Primary Examiner* — Mahmoud Gimie
(74) *Attorney, Agent, or Firm* — Warn Partners, P.C.

(57) ABSTRACT

An engine (10, 100, 200, 34) assembly comprising an engine (36), at least one exhaust gas recirculation valve, (54) at least one throttle valve, and an actuator (12,112,212) operably connected to the EGR valve (56) and the throttle valve (54). The actuator (12, 112, 212) can be operably connected to any predetermined combination of a predetermined number of EGR valves (56) and a predetermined number of throttle valves (54). The actuator (12, 112, 212) can be a mechanical actuator, a pneumatic actuator, a hydraulic actuator, or an electrical actuator.

22 Claims, 2 Drawing Sheets

TWO COMPONENT LOW PRESSURE EGR MODULE

CROSS-REFERENCE TO RELATED APPLICATIONS

This application is a National Stage of International Application No. PCT/US2007/007074, filed Mar. 22, 2007. This application claims the benefit of U.S. Provisional Application No. 60/784,568, filed Mar. 22, 2006.

FIELD OF THE INVENTION

The present invention relates to an engine assembly having an actuator connected to an EGR valve and a throttle valve.

BACKGROUND OF THE INVENTION

Due to both federal and state regulations, motorized vehicles today are limited to the amount of emissions in which they can release during operation. One way of reducing the amount of emissions released by the vehicle is to include an exhaust gas recirculation (EGR) valve in the vehicle's exhaust system. The EGR valve redirects at least a portion of the gaseous fluid from the exhaust manifold of the engine, so that the gaseous fluid is recirculated into the intake manifold of the engine along with fresh air. The gaseous fluid recirculated into the engine's intake manifold reduces the temperature of the combustions during engine operation which reduces the amount of emissions created as a result of the combustion.

The engine assemblies typically include at least one EGR valve and other types of valves which are controlled by actuators. However, the addition of valves to the engine assembly and the addition of actuators to control those valves increases the amount of materials and parts that need to be assembled in order to make the engine assembly.

Therefore, it is desirable to develop an assembly in which multiple valves can be controlled by a single actuator. This reduction in the number of actuators would allow for a reduction in the number of parts that need to be manufactured and assembled to create the engine assembly.

SUMMARY OF THE INVENTION

The present invention relates to an engine assembly comprising an engine, at least one exhaust gas recirculation valve, at least one throttle valve, and an actuator operably connected to the EGR valve and the throttle valve. The actuator can be operably connected to any predetermined combination of a predetermined number of EGR valves and a predetermined number of throttle valves. The actuator can be a mechanical actuator, a pneumatic actuator, a hydraulic actuator, or an electrical actuator.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
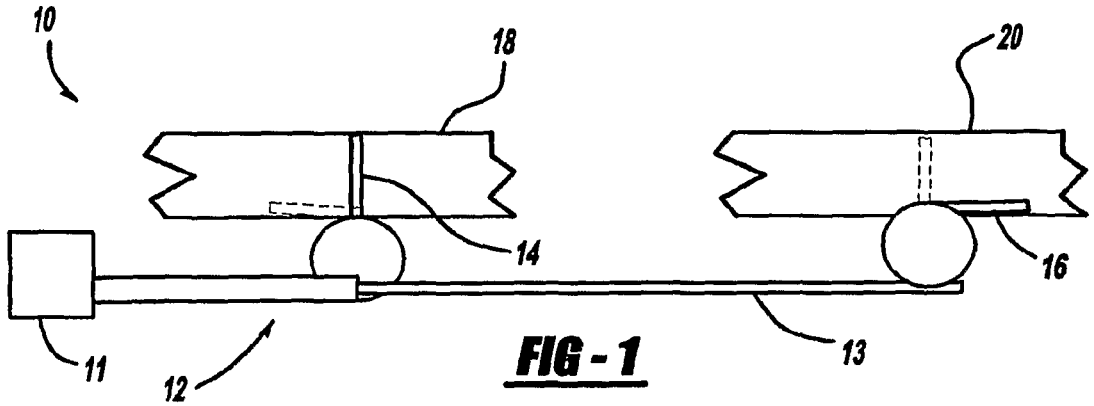
FIG. 1 is a schematic view of an actuator operably connected to valves in accordance with a first embodiment of the present invention.

The following description of the preferred embodiment(s) is merely exemplary in nature and is in no way intended to limit the invention, its application, or uses.

Referring to FIGS. 1-4, a valve assembly is generally shown at 10. The valve assembly 10 has an actuator generally indicated at 12, a first valve 14, and a second valve 16. The actuator 12 through a linkage is operably connected to the first valve 14 and second valve 16 so that the actuator 12 alters the position of both the first valve 14 and the second valve 16. However, it should be appreciated that any predetermined number of valves 14, 16 can be operably connected to the actuator 12 so that the actuator 12 can control the valves simultaneously.

In all of the embodiments disclosed below, it is preferred that the first valve 14 be substantially open with respect to the first passageway 18 prior to the second valve 16 being altered with respect to the second passageway 20 for reasons described in greater detail below. The second valve 16 remains closed when the first valve 14 is closed. The open and closed relationship between the valves 14, 16 is shown in FIGS. 1-4 by the valves 14, 16 position shown by solid lines and phantom.

With continued reference to FIG. 1, the first embodiment shows a mechanical actuator 12 operably connected to the first valve 14 and second valve 16. In a preferred embodiment, the actuator 12 is an electric motor 11 having a linkage 13 that is a Bowden cable or a push-pull cable connected to the valves 14, 16. Although any type of fixed mechanical linkage can be used. As the actuator 12 is actuated the position of the first valve 14 with respect to the first passageway 18 is altered and when the first valve 14 is in a predetermined position the actuator 12 will cause the second valve 16 to move. Thus, the actuator 12 and second valve 16 act as a lost motion device, such that the second valve 16 is not actuated until the first valve 14 is in a predetermined position. In another alternate embodiment of the invention the electric motor is coupled directly to one of the valves 14, 16 and drives the valve with a direct drive gear or gear train, in addition to the electric motor being coupled to the other valve that is not directly coupled to the electric motor with a linkage.

Figure 2:
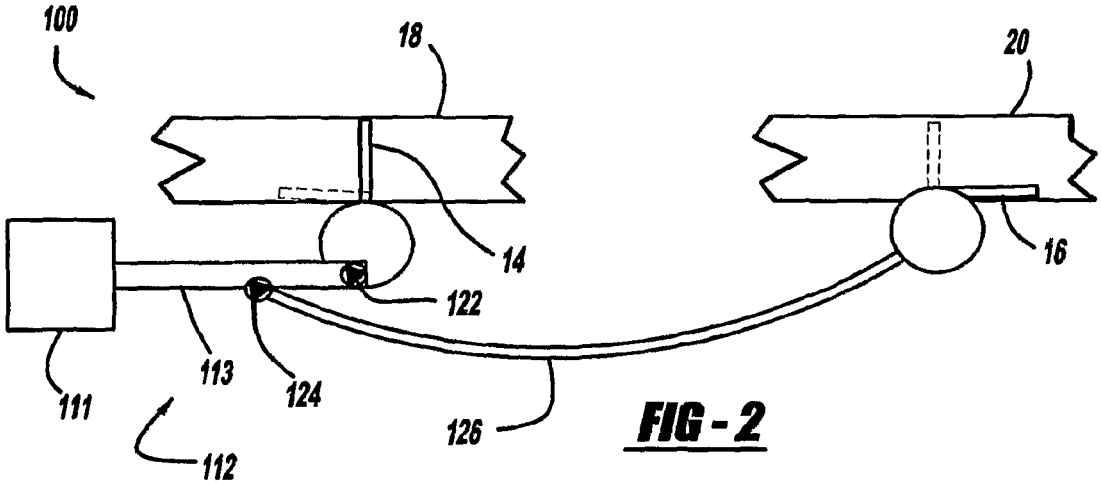
FIG. 2 is a schematic view of the actuator operably connected to the valves in accordance with a second embodiment of the present invention.

Referring to FIG. 2, a second embodiment of the valve assembly is generally shown at 100. The valve assembly 100 has an actuator that is generally indicated at 112. In a preferred embodiment, the actuator 112 is an electric motor 111 connected to a linkage 113 that is pneumatic and is operably connected to the first valve 14 and second valve 16. The pneumatic linkage 113 causes the air pressure to decrease in the linkage 113 at the first valve 14. The decrease in air pressure causes the first valve 14 to move to a predetermined position with respect to the first passageway 18. Once the first valve 14 is in the predetermined position, a valve 124 that is located at the connector point between the linkage 113 and a second connector 126 is opened. Thus, the valve 124 opens after a predetermined pressure is reached in the first passageway 18. Once the valve 124 is opened the pressure decreases in the second connector 126 which causes the second valve 16 to move.

Figure 3:
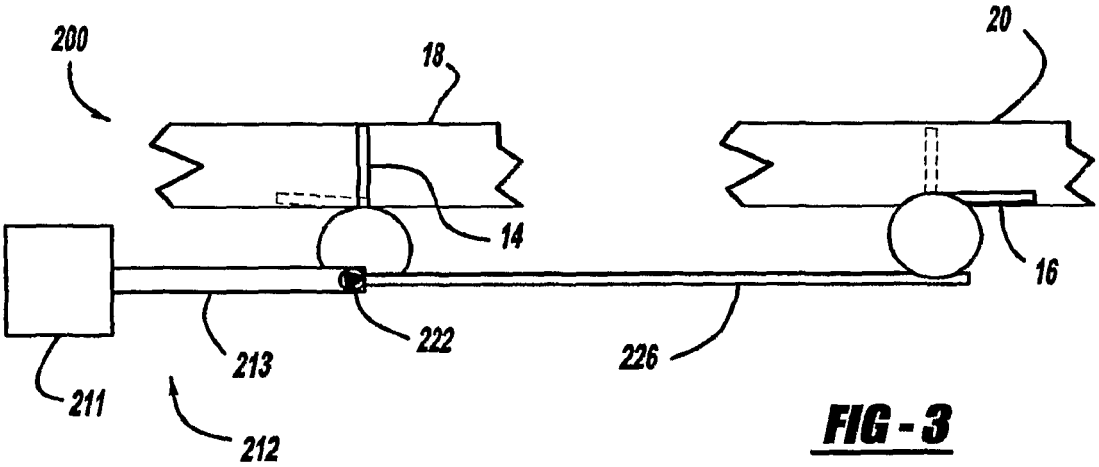
FIG. 3 is a schematic view of the actuator operably connected to the valves in accordance with a third embodiment of the present invention.

Referring the FIG. 3, a third embodiment of the valve assembly is generally shown at 200. The valve assembly 200 has an actuator 212 which is an electric motor 211 operably coupled to a hydraulic linkage 213. While an electric motor is described it is within the scope of this invention to use some other type of electrical actuator and not necessarily an electric motor. For example the electric actuator can be valves for hydraulics or pneumatics such as a spool valve or other types of electrically actuated valve. The electric motor 211 causes hydraulic fluid to flow through the hydraulic linkage 213 to the first connector 222 to alter the position of the first valve 14 with respect to the first passageway 18. As the hydraulic actuator 212 is actuated, the pressure in the hydraulic linkage 212 is increased and pressure in a second connector 226 is increased. In a preferred embodiment, the first valve 14 is actuated at a first predetermined pressure at the first connector 222 and the second valve 16 is actuated at a second predetermined pressure at the second connector 226, where the second pressure is higher than the first pressure. Thus, the first valve 14 is actuated prior to the second valve 16. Alternatively a valve can be used to control the flow to both the first connector 222 and second connector 226.

Figure 4:
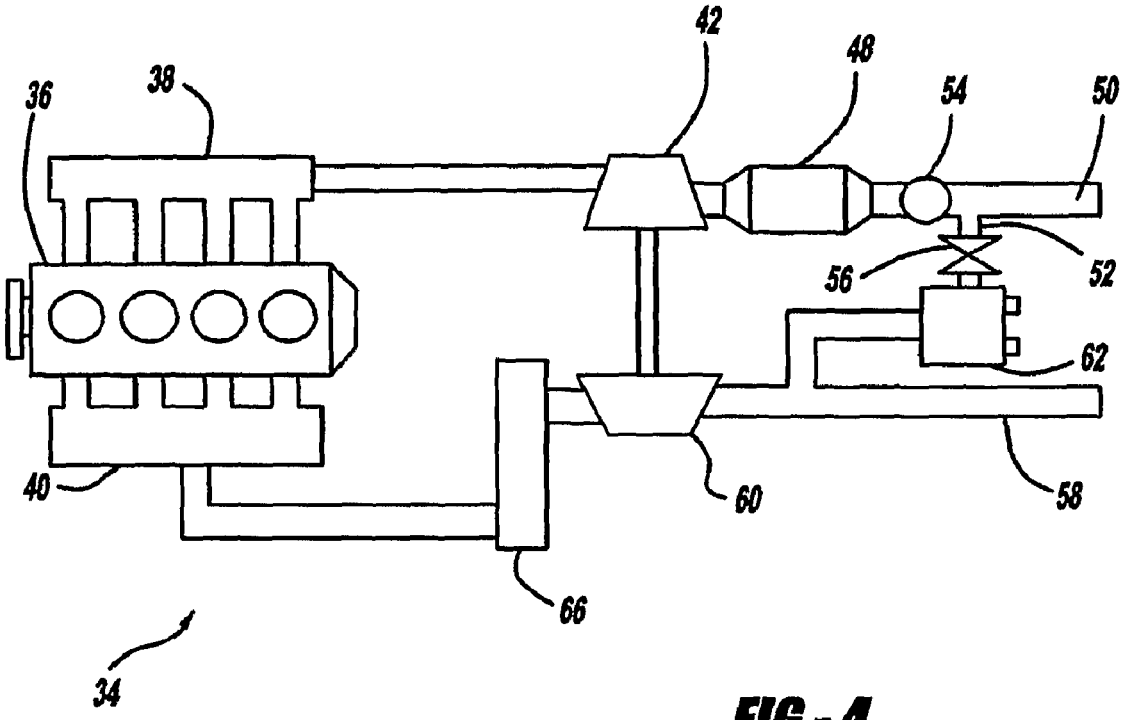
FIG. 4 is a schematic plan view of an engine assembly in accordance with the present invention.

Referring to FIG. 4, in operation the valve assembly 10, 100, 200, 300 is used in an engine assembly which is generally shown at 34. The engine assembly 34 has an engine 36 which comprises an exhaust manifold 38 and an intake manifold 40. A turbine is operably connected to the exhaust manifold 38, such that the gaseous fluid or exhaust gas flows through the turbine 42. The gaseous fluid that passes through the turbine 42 rotates the turbine 42 and then passes through a diesel particulate filter (DPF) 48. The gaseous fluid then passes through an exhaust pipe 50 or an EGR path 52. The gaseous fluid that passes through the exhaust pipe 50 exits the engine assembly 34. The gaseous fluid that passes through the EGR path 52 passes through an EGR valve 56. In a preferred embodiment the EGR valve 56 is a low pressure EGR valve. A throttle valve 54 is used to control the amount of gaseous fluid flowing through the exhaust pipe 50 and the EGR path 52.

The gaseous fluid that passes through the EGR path 52 then passes through an EGR cooler 62 and mixes with fresh air from an inlet 58. The combination of gaseous fluid and fresh air pass through a compressor 60, which is operably connected to the turbine 42. Thus, as the gaseous fluid passes through and rotates the turbine 42, the turbine 42 causes the compressor 60 to rotate and compress the gaseous fluid and fresh air mixture.

Referring to FIGS. 1-4, a predetermined number of valve positioning sensors (not shown) are used to determine the position of the valves 14, 16. The valve positioning sensors are operably connected to a control unit (not shown) which is used to actuate the actuator 12, 112, 212, 312 and change the position of the valves 14, 16. In a preferred embodiment the control unit is the Engine Control Unit (ECU) or a control unit connected to the ECU. However, the control unit can be part of the actuator 12, 112, 212, 312 so that it can determine how to move the valves 14, 16.

In a preferred embodiment, the actuator 12, 112, 212, 312 is used to control the exhaust gas throttle valve 54 and the EGR valve 56. Thus, the EGR valve 56 is represented by the first valve 14, and the exhaust gas throttle valve 54 is represented by the second valve 16 in FIGS. 1-4.

In a preferred embodiment, the EGR valve 56 is substantially open before the throttle valve 54 is altered or closed. When the EGR valve 56 is substantially open and the throttle valve 54 is closed, the flow through the EGR valve 56 is increased. Thus, it is preferred that the EGR valve 56 is substantially open prior to altering the throttle valve 54 because it is undesirable to increase the back pressure of the gaseous fluid, which increases the flow of the gaseous fluid through the EGR path 52 if the EGR valve 56 is not substantially open. However, it is within the scope of the present invention for the actuator 12, 112, 212, 312 to actuate the EGR valve 56 and throttle valve 54 in a different manner so long as the EGR valve 56 and throttle valve 54 are actuated in conjunction.

In a preferred embodiment, the EGR valve 56 and throttle valve 54 are relatively close to one another in the engine assembly 34 in order to reduce the size of the actuator 12, 112, 212, 312 that is used to actuate the EGR valve 56 and throttle valve 54. The shorter the distance between the EGR valve 56 and throttle valve 54 allows for less materials to be used in order to make the connector between the EGR valve 56 and throttle valve 54. However, it should be appreciated that due to the design of the actuator 12, 112, 212, 312 any predetermined distance can be placed between the EGR valve 56 and throttle valve 54.

This type of connection can be used in different manner in engine assemblies where multiple valves are controlled in the same manner. For example, if the engine assembly has a bypass around a cooler the EGR valve and a bypass valve can be operably connected to an actuator. These types of connections are described in greater detail in a patent application having the same inventor, Volker Joergl, filed on Mar. 22, 2006, entitled "Integrated Charge Air and EGR Valve," hereby incorporated into this application by reference.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An engine assembly comprising:

an engine;

at least one exhaust gas recirculation valve operably connected to said engine;

at least one throttle valve operably connected to said engine;

an actuator operably connected to a predetermined combination of said at least one exhaust gas recirculation valve and said at least one throttle valve; and a linkage connected to both said at least one exhaust gas recirculation valve and said at least one throttle valve, wherein said linkage substantially opens said at least one exhaust gas recirculation valve prior to altering the position of said at least one throttle valve.

2. The engine assembly of claim 1, wherein said exhaust gas recirculation valve is in a first housing and said throttle valve is in a second housing.

3. The engine assembly of claim 1, wherein said actuator includes an electric motor and said linkage is a cable extending from said electric motor to said at least one exhaust gas recirculation valve and to said at least one throttle valve.

4. The engine assembly of claim 1 wherein said actuator is connected to one valve of said predetermined combination of said at least one exhaust gas recirculation valve or said at least one throttle valve using a direct drive gear, and another valve of said predetermined combination of said at least one exhaust gas recirculation valve and said at least one throttle valve being actuated by said linkage between said one valve and said another valve.

5. The engine assembly of claim 4 wherein said direct drive gear is a series of two or more gears.

6. The engine assembly of claim 1, wherein said actuator includes one selected from the following group comprising: an electric motor, pneumatic valves, and hydraulic valves; and wherein said linkage is a pneumatic linkage with a first connector extending to said exhaust gas recirculation valve and a second connector extending from said first connector to said throttle valve.

7. The engine assembly of claim 1, wherein said actuator includes one selected from the group comprising: an electric motor, pneumatic valves, and hydraulic valves; and wherein said linkage is a hydraulic linkage with a first connector extending to said exhaust gas recirculation valve and a second connector extending from said first connector to said throttle valve.

8. The engine assembly of claim 1 further comprising at least one valve positioning sensor operably connected to at least one of said exhaust gas recirculation valve and said throttle valve.

9. The engine assembly of claim 1 further comprising a control unit operable connected to said actuator.

10. The engine assembly of claim 9, wherein said control unit is directly connected to said actuator, so that said control unit determines the position of said actuator and controls the movement of said actuator.

11. The engine assembly of claim 9, wherein said control unit is integrated into an engine control unit, and said actuator changes positions when said actuator receives signals from said engine control unit.

12. An engine assembly comprising:

an engine, wherein said engine has an intake manifold and an exhaust manifold;

at least one exhaust gas recirculation valve operably connected to said intake manifold and said exhaust manifold, wherein said at least one exhaust gas recirculation valve is in a first housing;

at least one throttle valve operably connected to said exhaust manifold, wherein said at least one throttle valve is in a second housing; and an actuator operably connected to a predetermined combination of said at least one exhaust gas recirculation valve and said at least one throttle valve and;

a linkage connected to both said at least one exhaust gas recirculation valve and said at least one throttle valve, wherein said linkage substantially opens said at least one exhaust gas recirculation valve prior to altering the position of said at least one throttle valve.

13. The engine assembly of claim 12, wherein said actuator includes an electric motor connected to said linkage and said linkage is a cable extending from said electric motor to said exhaust gas recirculation valve and to said throttle valve.

14. The engine assembly of claim 12 wherein said actuator is connected to one valve of said predetermined combination of said at least one exhaust gas recirculation valve or said at least one throttle valve using a direct drive gear, and another valve of said predetermined combination of said at least one exhaust gas recirculation valve and said at least one throttle valve being actuated by said linkage between said one valve and said another valve.

15. The engine assembly of claim 14 wherein said direct drive gear is a series of two or more gears.

16. The engine assembly of claim 12, wherein said actuator includes one selected from the group comprising: an electric motor, pneumatic valves, and hydraulic valves; and wherein said linkage is a pneumatic linkage with a first connector extending to said exhaust gas recirculation valve and a second connector extending from said first connector to said throttle valve.

17. The engine assembly of claim 12, wherein said actuator includes one selected from the group comprising: an electric motor, pneumatic valves, and hydraulic valves; and wherein said linkage is a hydraulic linkage with a first connector extending to said exhaust gas recirculation valve and a second connector extending from said first connector to said throttle valve.

18. The engine assembly of claim 12, wherein said at least one throttle valve is connected to said intake manifold in a second housing.

19. The engine assembly of claim 12 further comprising at least one valve positioning sensor operably connected to at least one of said exhaust gas recirculation valve and said throttle valve.

20. The engine assembly of claim 12 further comprising a control unit operable connected to said actuator.

21. An engine assembly comprising:

an engine, wherein said engine has an intake manifold and an exhaust manifold;

at least one exhaust gas recirculation valve operably connected to said intake manifold and said exhaust manifold, wherein said at least one exhaust gas recirculation valve is in a first housing;

at least one throttle valve operably connected to said exhaust manifold, wherein said at least one throttle valve is in a second housing;

an actuator operably connected to a predetermined combination of said at least one exhaust gas recirculation valve and said at least one throttle valve, a linkage connected to both said at least one exhaust gas recirculation valve and said at least one throttle valve, wherein said linkage substantially opens said at least one exhaust gas recirculation valve prior to altering the position of said at least one throttle valve;

a control unit operably connected to said actuator; and at least one valve positioning sensor operably connected to at least open to said exhaust gas recirculation valve and said throttle valve.

22. The engine assembly of claim 21, wherein said linkage is one selected from a mechanical linkage, a pneumatic linkage or a hydraulic linkage.

* * * * *